United States Patent [19]

Aicher et al.

[11] Patent Number: 4,550,961

[45] Date of Patent: Nov. 5, 1985

[54] ELECTROSURGICAL ELECTRODE CONNECTOR

[75] Inventors: Frederick T. Aicher, Miamisburg; James R. Martin, Sr., Waynesville; William T. Flanagan, Kettering, all of Ohio

[73] Assignee: NDM Corporation, Dayton, Ohio

[21] Appl. No.: 634,857

[22] Filed: Jul. 26, 1984

[51] Int. Cl.[4] ..... H01R 13/639

[52] U.S. Cl. ..... 339/14 R; 339/91 R; 339/176 MF; 339/253 R

[58] Field of Search ..... 339/17 F, 176 MF, 91 R, 339/261, 255 P, 14 R, 253 R; 128/303.13, 303.14, 798, 640

[56] References Cited

U.S. PATENT DOCUMENTS

| | | | |
|---|---|---|---|
| 3,699,968 | 10/1972 | Bolduc | 128/303.13 |
| 3,842,394 | 10/1974 | Bolduc | 339/75 |
| 3,879,099 | 4/1975 | Shaffer | 399/99 |
| 3,895,635 | 7/1975 | Justus et al. | 128/303.13 |
| 3,911,241 | 10/1975 | Jarrard | 200/157 |
| 3,999,829 | 12/1976 | Yurtin | 339/176 MF |
| 4,014,343 | 3/1977 | Esty | 128/303.14 |
| 4,032,738 | 6/1977 | Esty et al. | 200/157 |
| 4,066,078 | 1/1978 | Berg | 128/2.06 |
| 4,094,571 | 6/1978 | Benjamin | 339/91 R |
| 4,112,941 | 9/1978 | Larimore | 128/2.06 |
| 4,165,141 | 8/1979 | Williams et al. | 339/75 R |
| 4,166,465 | 9/1979 | Esty et al. | 128/303.13 |
| 4,206,960 | 6/1980 | Tantillo et al. | 339/61 R |
| 4,225,205 | 9/1980 | Sinclair et al. | 339/176 MF |
| 4,273,135 | 6/1981 | Larimore et al. | 128/640 |
| 4,311,145 | 1/1982 | Esty et al. | 128/303.17 |
| 4,352,359 | 10/1982 | Larimore et al. | 128/640 |

FOREIGN PATENT DOCUMENTS

| | | | |
|---|---|---|---|
| 2844346 | 4/1979 | Fed. Rep. of Germany | 339/17 F |

*Primary Examiner*—John McQuade

*Attorney, Agent, or Firm*—Killworth, Gottman, Hagan & Schaeff

[57] ABSTRACT

A connector for connecting a pair of electrical leads to a ground electrode includes an upper connector plate and a lower connector plate, both formed of an electrically non-conductive material, and a pair of leaf spring contact means which are connected to said upper and lower connector plates and by which the plates are spring biased apart. A pair of connector posts are mounted on the side of the lower plate facing the upper plate, and may be engaged by a spring biased latch means carried on the upper plate. The latch means holds the lower and upper plates together securely with the connection tab of an electrode therebetween.

10 Claims, 8 Drawing Figures

ELECTROSURGICAL ELECTRODE CONNECTOR

BACKGROUND OF THE INVENTION

The present invention relates to an electrical connector and, more particularly, to a connector specifically configured for use with an electrosurgical ground electrode.

In electrosurgical procedures, an electrical generator produces a high frequency electric current which is applied to an active electrode. The active electrode may be configured as a scalpel which is used to cut tissue. The electric current causes coagulation at the incision, reducing bleeding. An indifferent or ground electrode is attached to the patient and provides a return path to the generator for the high frequency current. The current supplied to the active electrode is concentrated in a relatively small area and high current densities are therefore obtained at the surgical site. It is essential, however, that the indifferent electrode provide for the current return to the generator over a relatively large surface area to maintain a low current density and thereby avoid injury to the tissue of the patient in this area.

It will be appreciated that it is of great importance that the current return path through the ground electrode to the electrosurgical generator remain unimpaired. If this current path should be interrupted, the electrosurgical current will be diverted to such alternate ground paths as may be available, such as for example EKG electrodes attached to the patient or other grounded equipment in the operating room which may come into contact with the patient. Due to the much smaller surface area typically presented by such alternate ground paths, it is very likely that the patient will be burned at the point where the current exits the patient's body.

It will be appreciated that not only must the ground electrode remain securely attached to the patient during the surgical procedure, but also the lead from the electrosurgical generator must be securely connected to the ground electrode by an appropriate connector. Such connectors are shown, for example, in U.S. Pat. No. 3,699,968, issued Oct. 24, 1972, to Bolduc; U.S. Pat. No. 3,842,394, issued Oct. 15, 1974, to Bolduc; and U.S. Pat. No. 4,166,465, issued Sept. 4, 1979, to Esty.

In a connector such as shown in Bolduc '968, a pair of arms extend from the connector body which, when pressed together, cause connec or jaws to separate. The jaws are opened to permit insertion of the ground electrode therebetween. When the arms are released, the jaws close and the electrode is thereby engaged by the connector. The problem with such a connector is that the connector cannot be placed beneath the patient's body in a position where a weight may be brought to bear upon the arms, since this would tend to open the connector jaws and reduce the conductivity between the ground electrode and the connector.

Bolduc '394, discloses a cam lock mechanism which is pivoted by a lever to press the connector jaws together. Although the weight of the patient's body on such a connector does not tend to open the connector jaws, the connector is relatively thick and it may be difficult to use in certain positions on the patient's body. Bolduc '394 also discloses an embodiment which defines a slot into which the ground electrode is inserted. A sharp pin on a spring member then pierces the electrode. Although relatively thin, this connector does not provide for a positive clamping force against the surface of the electrode. Thus, if the electrode is too thick it is difficult to insert in the connector slot. If the electrode is too thin the side walls of the connector slot may not press against it firmly and thus a good electrical path to the electrode may not be established.

Finally, the Esty patent discloses a connector which includes a molded plastic body having upper and lower plastic halves which bear male and female, opposed snap-type fasteners, respectively. The body is molded to spring bias the snap-type fasteners apart. The snap-type fasteners are pressed together through an opening in a tab extending from the ground electrode. The fasteners thus provide a means of attaching the connector to the electrode. It will be appreciated that the snap-type fastener arrangement is not a positive locking mechanism and, therefore, the possibility exists that the spring force produced by the molded plastic body of the connector could cause the connector to open. Further, such a snap fastener arrangement is subject to accidental opening if inadvertently jarred during a surgical procedure.

It is seen, therefore, that there is a need for a simple, relatively flat electrical connector which may be positively locked in engagement with an electrosurgical ground electrode.

SUMMARY OF THE INVENTION

A connector for connecting an electrical lead to a ground electrode of the type used with an electrosurgical generator, in which the electrode has a connection tab extending from the periphery thereof and defining an electrically conductive surface on at least one side of the tab and a connector engagement opening extending through the tab, includes an upper connector plate formed of an electrically nonconductive material and a lower connector plate formed of an electrically nonconductive material. The upper and lower plates each define hinge connection means at first ends thereof for connecting the upper and lower plates together. A leaf spring contact means includes first and second contact legs. The first contact leg engages the upper connector plate and the second contact leg engages the lower connector plate. The first and second contact legs are joined together adjacent the hinge connection means. The upper and lower connector plates are spring biased apart and the electrical lead is connected to the leaf spring contact means.

A connector post is mounted on the side of the lower plate facing the upper plate. The post defines an engagement notch. The connector post is sized such that the connection tab may be inserted between the upper connector plate and the lower connector plate and the connector engagement opening pressed over the connector post. A spring biased latch means is slideably mounted on the upper connector plate for engaging the connector post engagement notch when the upper and lower plates are pressed together. The upper and lower connector plates are held together by the latch means, pressing the first and second contact means against a connection tab held therebetween, whereby an electrical path is established between the lead and the ground electrode.

The latch means may comprise a latch plate mounted on the upper plate so as to be slideable between a first position, in which the connector post engagement notch is engaged, and a second position, in which the notch is not engaged. A biasing means spring biases the latch plate toward the first position. A manual release means is provided for moving the latch plate into the second position against the spring biasing, thereby releasing the connector post and permitting the plates to be separated.

The biasing means comprises a leaf spring in contact with the latch plate. The manual release means may comprise means defining a curved portion on the latch plate at the end thereof opposite the biasing means.

The leaf spring contact means may define a first opening in the first contact leg and a second opening in the second contact leg. The first and second contact openings are sized and positioned such that the connector post may extend therethrough.

According to the present invention, the connector may further provide for connecting a pair of electrical leads to a ground electrode having a connection tab which defines a pair of connector engagement openings extending through the tab. In such an arrangement, the connector includes a pair of leaf spring contact means, each of which is connected to an associated one of the pair of electrical leads. A pair of connector posts are mounted on the lower plate and the spring biased latch means engages the connector post engagement notches in both of the connector posts.

Accordingly, it is an object of the present invention to provide a connector for connecting one or more electrical leads to an electrosurgical ground electrode in which the connection tab of the electrode is securely engaged; to provide such a connector in which the connection tab defines at least one opening engaged by a post carried on the connector; to provide such a connector in which the post is securely engaged by a latch; to provide such a connector in which the pressure of the patient's body resting on the connector does not tend to cause the connector to become disengaged from the electrode; and to provide such a connector which is relatively thin.

Other objects and advantages of the invention will be apparent from the following description, the accompanying drawings and the appended claims.

DETAILED DESCRIPTION OF THE PREFERRED EMBODIMENT

Figure 1:
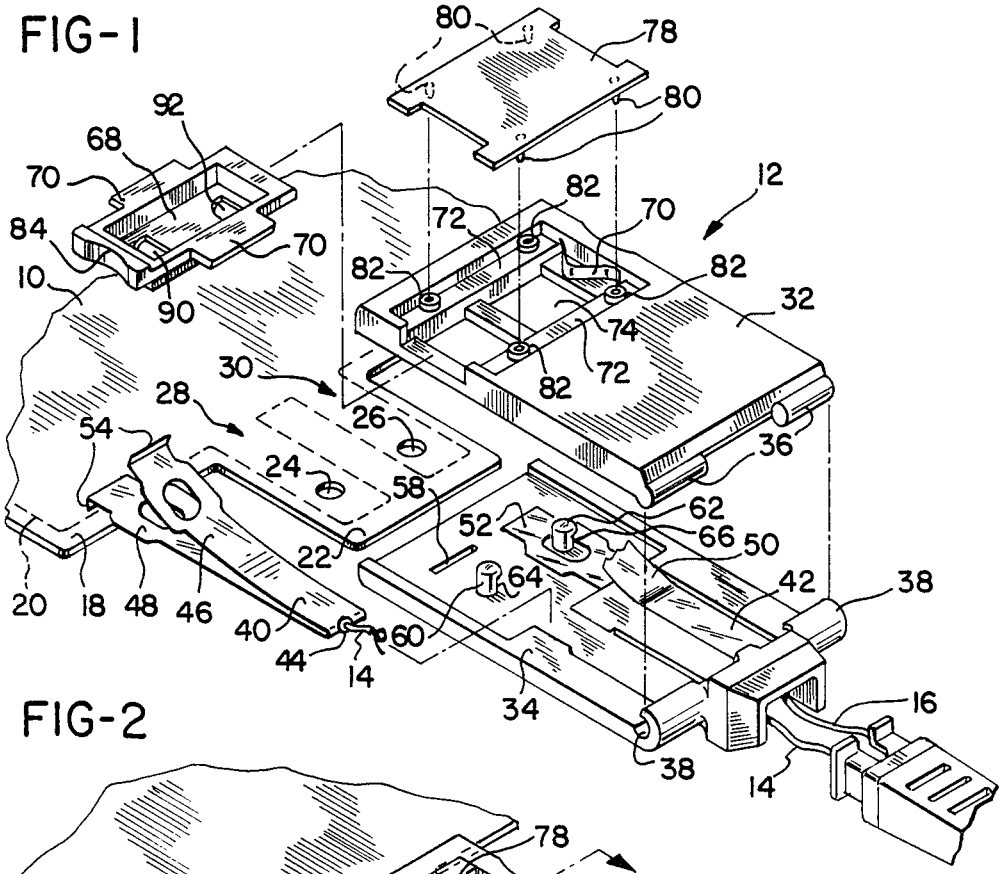
FIG. 1 is an exploded view, taken in perspective, of the connector of the present invention and a portion of an electrosurgical ground electrode.
Figure 2:
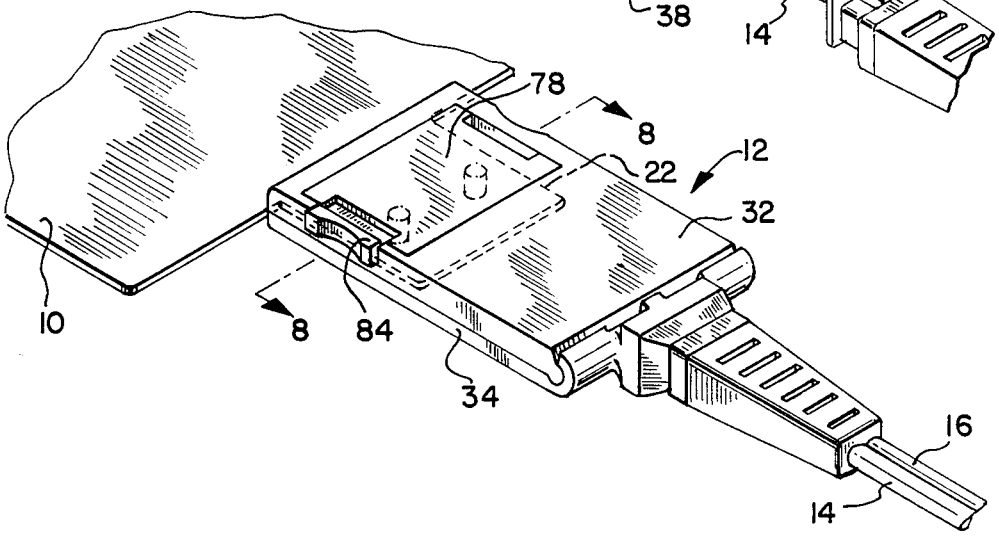
FIG. 2 is a perspective view illustrating engagement of a ground electrode by the connector.
Figure 3:
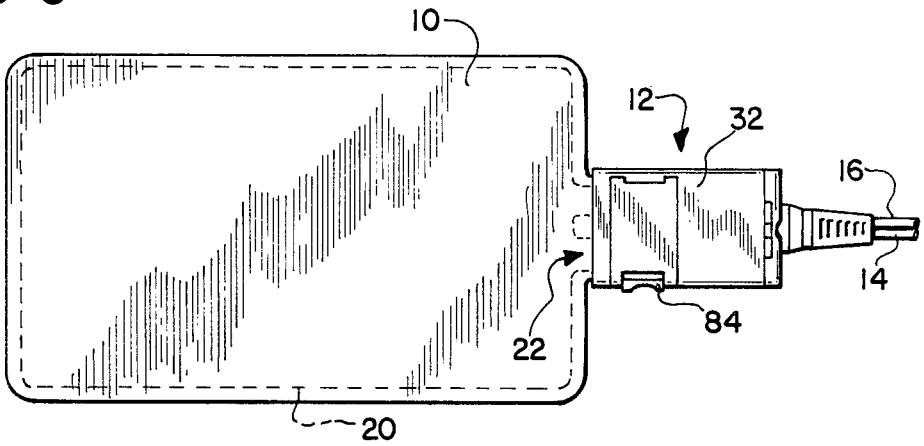
FIG. 3 is a top view illustrating engagement of the ground electrode by the connector.

FIGS. 1–3 illustrate an electrosurgical ground electrode 10 and the manner in which such an electrode is engaged by the connector 12, constructed according to the present invention, to connect a pair of electrical leads 14 and 16 thereto. During electrosurgery, high frequency current is applied to the patient using an active electrode, such as a scalpel, at the surgical site. A ground electrode is attached to the skin of a patient to provide the return path to the electrosurgical generator for this current.

Such a ground electrode is typically a multiple layer laminate structure which includes a foam backing layer 18. Beneath the backing layer 18 is a layer 20 of metalized Mylar or foil, the outline of which is indicated in FIG. 1 by dashed lines. In one type of electrode, the electrically conductive layer 20 directly contacts the skin of the patient. To hold the electrode 10 in position on the patient, the bottom surface of the electrode may be coated with a pressure sensitive adhesive around its margin. Alternatively, an electrically conductive, pressure sensitive adhesive may be coated over the entire bottom surface of the electrode. In a second type of electrode, a layer of dielectric material completely covers the bottom surface of the electrode such that there is a capacitive coupling between the body of the patient and the electrically conductive layer 20.

In either event, the electrode 10 further includes a connection tab 22 which extends from the periphery of the electrode. The electrically conductive layer 20 extends out into the tab 22 and, preferably, defines an electrically conductive surface on at least one side of the tab. The tab 22 further defines a pair of connector engagement openings 24 and 26 extending through the tab 22.

Conductive surface 20 extends onto tab 22 as a pair of electrically conductive strips 28 and 30 which are separated and electrically isolated on the tab 22. As will become apparent from the description below, lead wire 14 is electrically conducted to strip 28 while lead wire 16 is electrically connected to strip 30. By this arrangement, a monitor circuit in the electrosurgical generator may check the electrical continuity from the generator through the lead wire 14 to the electrode 10 and back to the generator via the lead wire 16. Should the connector 12 become detached from the electrode 10 or should the tab 22 be torn from the electrode 10 at the margin of the electrode, this monitor circuit will sound an alarm to warn of an inadequate return ground path to the generator. As will become apparent, the present invention is not, however, limited to use with such a generator, but may also be utilized with ground electrodes including only one conductive strip in the connection tab. With appropriate modification, a connector according to the present invention may be used with electrodes having only a single connector engagement opening in the connection tab.

Figure 7:
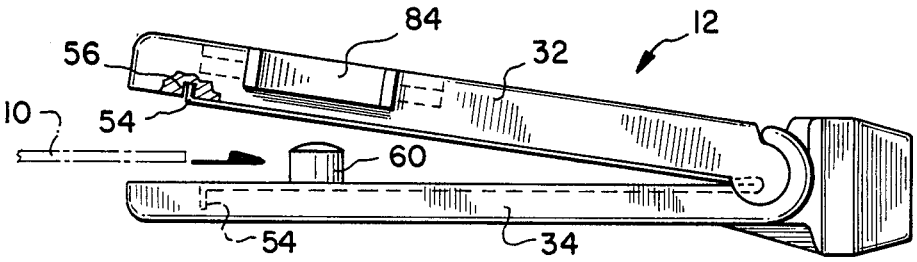
FIG. 7 is a side view of the connector with the upper and lower connector plate separated to receive the connection tab of an electrode.
Figure 4:
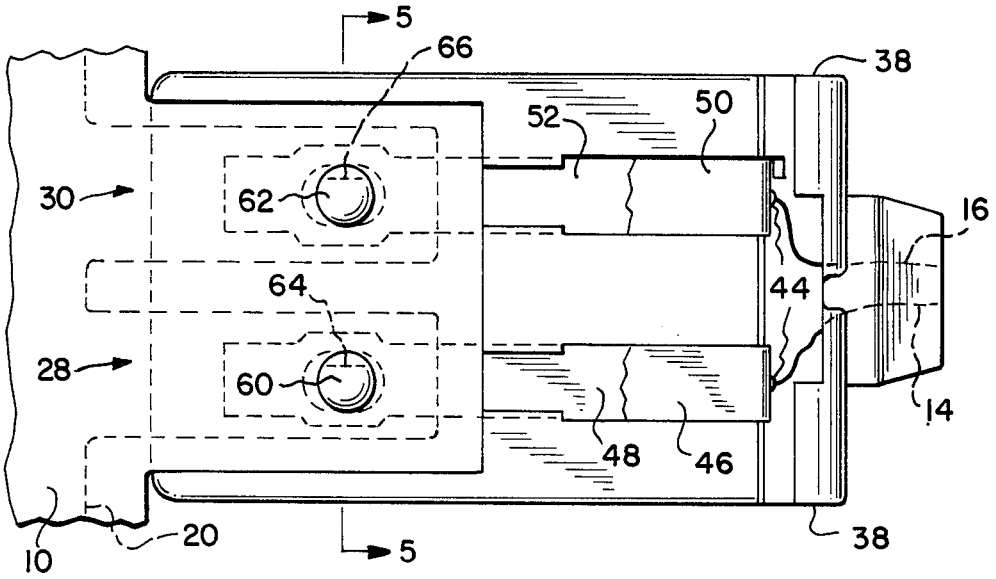
FIG. 4 is an enlarged top view of the connector engaging the connection tab of the electrode with the upper connector plate removed and the first contact legs of the leaf spring contact means being broken away.

The connector includes an upper connector plate 32 formed of an electrically non-conductive material, and a lower connector plate 34, also formed of an electrically non-conductive material. The upper and lower plates each define connection means at first ends thereof for connecting the plates 32 and 34 together. Plate 32 defines cylindrical portions 36 which are engaged by mating cylindrical recesses 38 in plate 34 so as to produce a hinge connection. This permits the plates 32 and 34 to be pivoted apart, as shown in FIG. 7, or pivoted together, as shown in FIG. 2. Each of a pair of leaf spring contact means 40 and 42 is connected to an associated one of the pair of electrical leads 14 and 16, as by soldering at 44. Contact means 40 includes a first contact leg 46 and a second contact leg 48. Similarly, contact means 42 includes first contact leg 50 and second contact leg 52. The first contact legs 46 and 50 engage the upper connector plate 32 while the second contact legs 48 and 52 engage the lower connector plate 34. As best seen in FIGS. 1 and 7, each of the contact legs defines outwardly turned end portions 54 which engage slots 56 and 58 defined by upper and lower plates 32 and 34, respectively. The leaf spring contact means are oriented such that they spring bias the plates 32 and 34 apart. As shown in FIG. 4, the leaf spring contact means 40 and 42 are situated on the plates 32 and 34 and separated apart so as to be electrically isolated from each other, thus making possible the continuity monitor arrangement discussed above.

Figure 5:
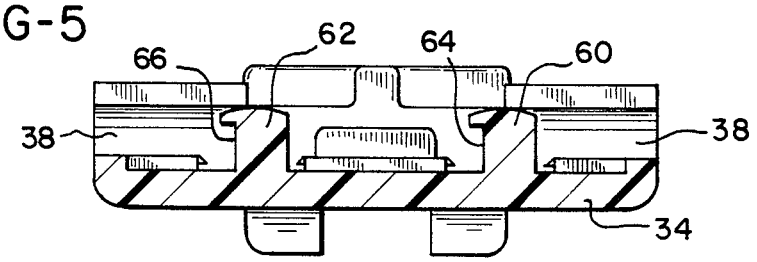
FIG. 5 is a sectional of the lower connector plate view taken generally along line 5—5 in FIG. 4.

A pair of connector posts 60 and 62 are mounted on the side of the lower plate 34 facing the upper plate 32. Posts 60 and 62 define associated engagement notches 64 and 66, respectively, as best seen in FIG. 5. The connector posts 60 and 62 are sized such that the connection tab 22 may be inserted between the upper connector plate 32 and the lower connector plate 34, and the connector engagement openings 24 and 26 may be pressed over the connector posts 60 and 62, respectively.

Figure 8:
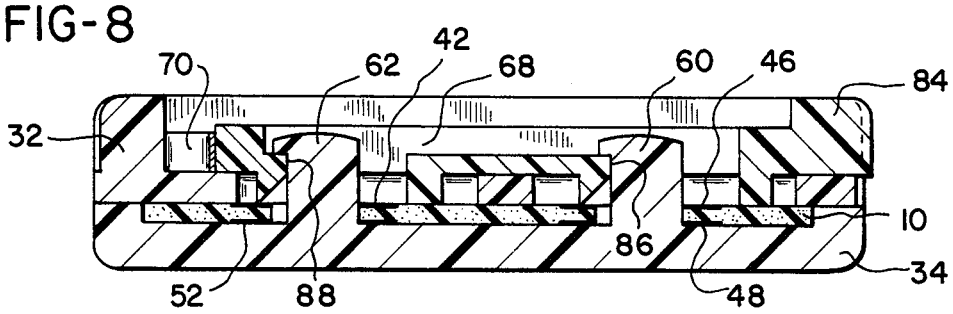
FIG. 8 is a sectional view taken generally along line 8—8 in FIG. 2, with the latch cover removed for purposes of clarity.
Figure 6:
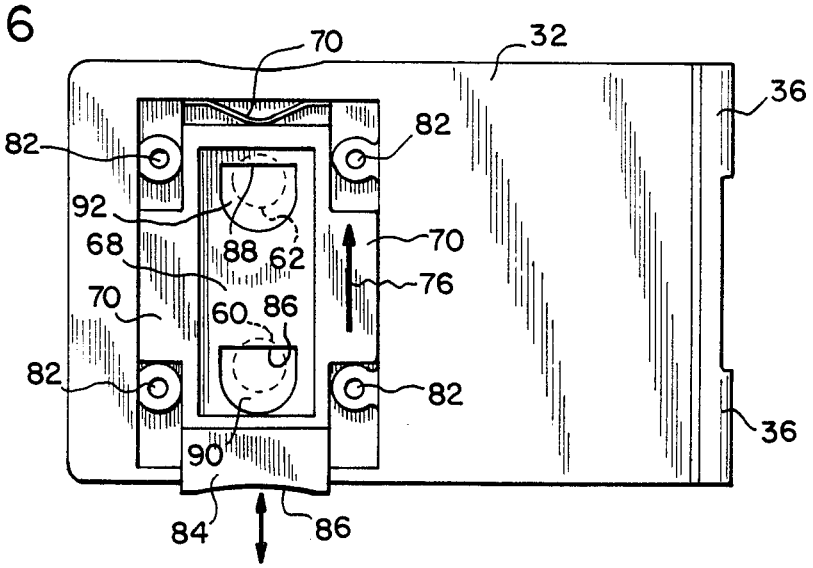
FIG. 6 is a top view of the upper connector plate and the spring biased latch, with the latch cover plate removed.

A spring biased latch means, including a latch plate 68 and a leaf spring 70, engages the connector post engagement notches 64 and 66 when the upper and lower connector plates are pressed together, as best shown in FIGS. 6 and 8. The upper and lower connector plates 32 and 34 are thereby held together, pressing the first and second contact legs of the contact means 40 and 42 against the connection tab 22.

The latch of plate 68 includes a pair of tabs 70 which rest on surfaces 72 to either side of opening 74. The latch plate 68 is slideable in a direction indicated by arrow 76 (FIG. 6) between a first position, in which the connector post engagement notches 64 and 66 are engaged, and a second position, in which the notches are not engaged. Plate 68 is held in position in opening 74 by a latch cover plate 78 which includes pins 80 pressed into openings 82. In order to move the latch plate 68 into its second position against the spring biasing force of spring 70, a manual release means including portion 84 defining a curved surface is provided at one end of the plate 68. The curved contact surface is manually pressed to slide plate 68 in the direction of arrow 76, whereby edges 86 and 88 of openings 90 and 92 in plate 68 are disengaged from notches 64 and 66, respectively.

When the connector 12 is closed with a tab 22 in proper position for engagement, first contact legs 42 and 46 contact the upper surface of tab 22 and second contact legs 48 and 52 contact the lower surface of tab 22, as shown in FIG. 8. Each of the contact legs 46, 48, 50, and 52 defines an opening therein such that the legs surround one of the engagement posts 60 and 62 as shown in FIG. 8. By this arrangement, the contact legs are pressed securely against the outer surfaces of the electrode 10.

It will be noted that the connector of the present invention provides for extremely secure engagement of an electrode tab while, at the same time, requiring a minimal connector thickness. Further, the latch arrangement of the connector is such that inadvertent pressure placed on the connector is unlikely to cause the connector to become detached from the electrode tab.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A connector for connecting an electrical lead to a ground electrode of the type used with an electrosurgical generator, said electrode having a connection tab extending from the periphery thereof and defining an electrically conductive surface on at least one side of said tab and further defining a connector engagement opening extending through said tab, comprising:

an upper connector plate formed of an electrically nonconductive material, a lower connector plate formed of an electrically nonconductive material, said upper and lower plates each defining hinge connection means at first ends thereof for connecting said upper and lower plates together, leaf spring contact means connected to said electrical lead and including first and second contact legs, said first contact leg engaging said upper connector plate and said second contact leg engaging said lower connector plate, said first and second contact legs being joined together adjacent said hinge connection means, whereby said upper and lower connector plates are spring biased apart, a connector post mounted on the side of said lower plate facing said upper plate, said post defining an engagement notch, said connector post being sized such that said connection tab may be inserted between said upper connector plate and said lower connector plate and said connector engagement opening pressed over said connector post, and spring biased latch means, slidably mounted on said upper connector plate, for engaging said connector post engagement notch when said upper and lower connector plates are pressed together, such that said upper and lower connector plates are held together, pressing said first and second contact legs against a connection tab held therebetween whereby said lead and said ground electrode are electrically connected.

2. The connector of claim 1 in which said latch means comprises:

a latch plate mounted on said upper plate, said latch plate being slidable between a first position in which said connector post engagement notch is engaged and a second position in which said notch is not engaged, biasing means for spring biasing said latch plate toward said first postion, and manual release means for moving said latch plate into said second position against said spring biasing, thereby releasing said connector post and permitting said plates to be separated.

3. The connector of claim 2 in which said biasing means comprises a leaf spring in contact with said latch plate.

4. The connector of claim 2 in which said manual release means comprises means defining a curved portion on said latch plate at the end thereof opposite said biasing means.

5. The connector of claim 1 in which said leaf spring contact means defines a first opening in said first contact leg and a second opening in said second contact leg, said first and second contact openings sized and positioned such that said connector post extends therethrough with said connection tab therebetween when said connection tab is engaged by said connector.

6. A connector for connecting a pair of electrical leads to a ground electrode of the type used with an electrosurgical generator, said electrode having a connection tab extending from the periphery thereof and defining an electrically conductive surface on at least one side of said tab and further defining a pair of connector engagement openings extending through said tab, comprising:

an upper connector plate formed of an electrically nonconductive material, a lower connector plate formed of an electrically nonconductive material, said upper and lower plates each defining hinge connection means at first ends thereof for connecting said upper and lower plates together, a pair of leaf spring contact means, each connected to an associated one of said pair of electrical leads and each including first and second contact legs, said first contact legs engaging said upper connector plate and said second contact legs engaging said lower connector plate, said first and second contact legs of each leaf spring contact means being joined together adjacent said hinge connection means, whereby said upper and lower connector plates are spring biased apart, said pair of leaf spring contact means separated apart so as to be electrically isolated from each other, a pair of connector posts mounted on the side of said lower plate facing said upper plate, each of said posts defining an engagement notch, said connector posts being sized such that said connection tab may be inserted between said upper connector plate and said lower connector plate and said connector engagement openings pressed over said connector posts, and spring biased latch means, slidably mounted on said upper connector plate, for engaging said connector post engagement notches when said upper and lower connector plates are pressed together, such that said upper and lower connector plates are held together, pressing said first and second contact legs of each of said pair of leaf spring contact means against a connection tab held therebetween whereby separate electrical paths are established between said leads and said ground electrode.

7. The connector of claim 6 in which said latch means comprises:

a latch plate mounted on said upper plate, said latch plate being slidable between a first position in which said connector post engagement notches are engaged and a second position in which said notches are not engaged, biasing means for spring biasing said latch plate toward said first position, and manual release means for moving said latch plate into said second position against said spring biasing, thereby releasing said connector posts and permitting said plates to be separated.

8. The connector of claim 7 in which said biasing means comprises a leaf spring in contact with said latch plate.

9. The connector of claim 7 in which said manual release means comprises means defining a curved portion on said latch plate at the end thereof opposite said biasing means.

10. The connector of claim 6 in which each of said pair of leaf spring contact means defines a first opening in said first contact leg and a second opening in said second contact leg, said first and second contact openings sized and positioned such that said connector posts extend therethrough with said connection tab therebetween when said connection tab is engaged by said connector.

* * * * *